US007066451B1

(12) United States Patent
Balcom

(10) Patent No.: US 7,066,451 B1
(45) Date of Patent: Jun. 27, 2006

(54) LINE TENSIONING DEVICE

(75) Inventor: Scott Balcom, 259 Bridge St., Ashland, OR (US) 97520

(73) Assignee: Scott Balcom, Ashland, OR (US)

( * ) Notice: Subject to any disclaimer, the term of this patent is extended or adjusted under 35 U.S.C. 154(b) by 0 days.

(21) Appl. No.: 10/928,795

(22) Filed: Aug. 30, 2004

Related U.S. Application Data

(60) Provisional application No. 60/499,330, filed on Sep. 2, 2003.

(51) Int. Cl.
*B21F 9/00* (2006.01)

(52) U.S. Cl. ..... 254/226; 254/393

(58) Field of Classification Search ..... 254/214, 254/215, 222, 225, 226, 393
See application file for complete search history.

(56) References Cited

U.S. PATENT DOCUMENTS

| | | | | |
|---|---|---|---|---|
| 947,595 | A * | 1/1910 | Moore | 254/223 |
| 1,180,666 | A * | 4/1916 | Manor | 254/222 |
| 1,520,628 | A * | 12/1924 | Anderson | 254/214 |
| 5,507,471 | A * | 4/1996 | Mercurio | 254/214 |
| 6,631,885 | B1 * | 10/2003 | Halas | 254/225 |

* cited by examiner

*Primary Examiner*—Emmanuel M Marcelo

(57) ABSTRACT

An improved line tensioning device comprising a pair of plates, anchoring means carried by one of said plates, line attachment means carried by the other of said plates, a plurality of pulley wheels mounted on each of said plates, pulley line means secured to one of said plates and passing alternately about the wheels of each of said plates, and brake means for releasably locking said pulley line means in a desired position.

7 Claims, 1 Drawing Sheet

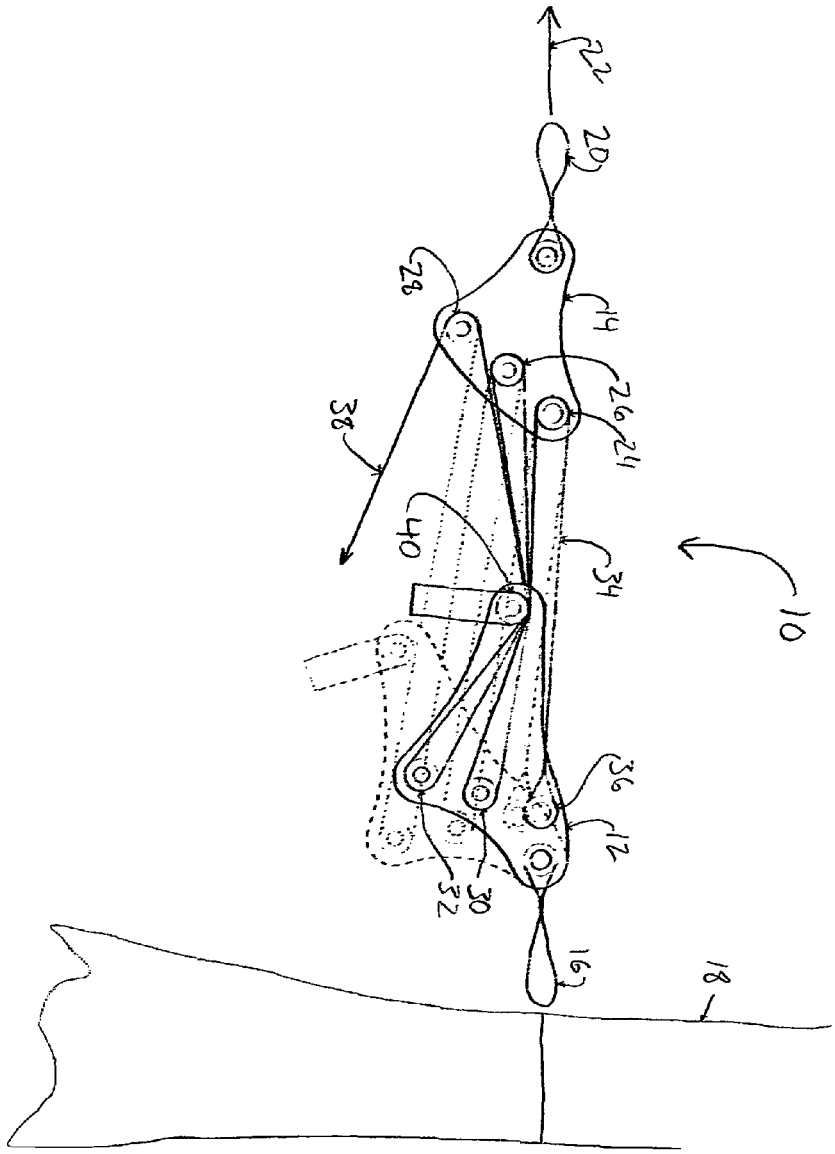
10
12
14
16
18
20
22
24
26
28
30
32
34
36
38
40

LINE TENSIONING DEVICE

RELATED CASES

This invention is described in my now abandoned provisional application Ser. No. 60/499,330, filed Sep. 2, 2003.

FIELD OF INVENTION

This invention relates to line tensioning devices and is particularly directed to improved line tensioning devices for use in securing cargo, tighening slackwalking wires and the like.

PRIOR ART

When securing a line, it is customary to anchor one end of the line, pass the line to a desired location and tighten the line until the desired tautness is achieved. Often this is done relying upon the physical strength of the user. However, in many instances, greater tensioning is needed. This is especially true in securing heavy or bulky cargo or in securing long lenghts of line, in which case the weight of the line may exceed the physical prowess of an individual. In these instances, some mechanical tensioning device is required and numerous such devices have been proposed heretofore. However, most of the prior art tensioning devices have been bulky and complicated to use. Also, many of the prior art tensioning devices have been prohibitively expensive or have failed to provide adequate tensioning. Thus, none of the prior art tensioning devices have been entirely satisfactory.

BRIEF SUMMARY AND OBJECTS OF INVENTION

These disadvantages of the prior art are overcome with the present invention and an improved line tensioning device is provided which is simple and inexpensive to produce and use and is light weight, yet provides a high mechanical advantage and assures adequate tensioning for virtually any purpose.

These advantages of the present invention are preferably attained by providing an improved line tensioning device comprising a pair of plates, anchoring means carried by one of said plates, line attachment means carried by the other of said plates, a plurality of pulley wheels mounted on each of said plates, pulley line means secured to one of said plates and passing alternately about the wheels of each of said plates, and brake means for releasably locking said pulley line means in a desired position.

Accordingly, it is an object of the present invention to provide an improved line tensioning device.

Another object of the present invention is to provide an improved line tensioning device which is simple and inexpensive to produce and use.

A further object of the present invention is to provide an improved line tensioning device which is simple and inexpensive to produce and use and is light in weight.

An additional object of the present invention is to provide an improved line tensioning device which is simple and inexpensive to produce and use and is light in weight, yet which provides a high mechanical advantage.

Another object of the present invention is to provide an improved line tensioning device which is simple and inexpensive to produce and use and is light in weight, yet which provides a high mechanical advantage and assures adequate tensioning for virtually any purpose.

A specific object of the present invention is to provide an improved line tensioning device comprising a pair of plates, anchoring means carried by one of said plates, line attachment means carried by the other of said plates, a plurality of pulley wheels mounted on each of said plates, pulley line means secured to one of said plates and passing alternately about the wheels of each of said plates, and brake means for releasably locking said pulley line means in a desired position.

These and other objects and features of the present invention will be apparent from the following detailed description, taken with reference to the figures of the accompanying drawing.

BRIEF DESCRIPTION OF THE DRAWING

The figure is a diagrammatic representation showing a line tensioning device embodying the present invention.

DETAILED DESCRIPTION OF THE INVENTION

In that form of the present invention chosen for purposes of illustration in the drawing, FIG. 1 shows a line tensioning device, indicated generally at 10, having a first plate 12 and a second plate 14. The first plate 12 carries suitable means, such as anchor loop 16 for releasably anchoring the first plate 12 to a fixed point 18, such as a tree or other strong permanent object. The second plate 14 carries attaching means, such as loop 20 for releasably attaching the second plate 14 to the line 22 to be tensioned. A plurality of pulley wheels 24, 26 and 28 are mounted on the second plate 14 while additional pulley wheels 30 and 32 are mounted on the first plate 12. A pulley line 34, such as nylon rope, webbing or the like, is secured to the first plate 12, as seen at 36, and passes alternately about pulley wheels 24, 30, 26, 32 and 28 and has its free end extending outward, as seen at 38. Finally, a brake member 40 is pivotally mounted on plate 12 and is movable between a braking position, shown in solid lines, in which it presses the runs of the pulley line 34 together to prevent movement thereof, and a release position, shown in dotted lines, in which the brake 40 is out of engagement with the pulley line 34. When the brake member 40 is in the locking or solid line position, the strands of the pulley line 34 are pressed together so that friction serves to lock them from moving. However, the mechanical advantage of the pulley wheels 24, 26, 28, 30 and 32 is sufficient to overcome the friction of the pulley line 34 to allow tightening of the line 22. However, when the brake member 40 is moved to the dotted line position, the friction of the pulley line 34 is released and the pulley line 34 can move freely.

In use, the user attaches the anchor loop 16 of plate 12 to a stationary object 18, such as a tree, and attaches the line 22 to be tensioned to loop 20 of second plate 14. Thereafter, pulley line 34 is attached to plate 12 and is wound alternately about the pulleys 24, 30, 26, 32 and 28. The free end 38 of the pulley line 34 is then pulled to draw the plates 12 and 14 toward each other with a mechanical advantage of six-to-one. This greatly enhances the user's ability to apply tension to the line 22. Finally, when the line 22 is properly tensioned, the user swings the self-locking brake 40 into solid line position of FIG. 1 to press the runs of the pulley line 34 together to prevent movement thereof. When the user desires to release the tension on line 22, he simply swings the brake 40 to the dotted line position of FIG. 1, which relieves the pressure against the runs of the pulley line 34, allowing the plates 12 and 14 to be moved apart and, thereby, releasing the tension on the line 22.

Obviously, if desired additional pulleys 24, 26, 28 30 and 32 could be provided and the pulley line 34 could be wound about those also to further increase the mechanical advantage provided by the line tensioning device 10. In addition, other variations and modifications can clearly be made without departing from the spirit of the present invention. Therefore, it should be clearly understood that the form of the present invention described above and shown in the figures of the accompanying drawing are illustrative only and are not intended to limit the scope of the present invention.

What is claimed is:

1. A line tensioning device comprising: a pair of plates, anchoring means carried by one of said plates, line attachment means carried by the other of said plates, a plurality of pulley wheels mounted on each of said plates, and pulley line means secured to one of said plates and passing alternately about the pulley wheels of each of said plates, brake means for releasably locking said pulley line means in a desired position, said brake means is pivotally mounted on one of said plates and is movable between a first position wherein said brake means serves to press several passes of said pulley line means against each other to prevent release of tension gained, and a second position out of contact with said pulley line means.

2. The device of claim 1 wherein: said anchoring means enables said device to be secured to a fixed item.

3. The device of claim 1 wherein: said line attachment means enables said device to be attached to a line to be tensioned.

4. The device of claim 1 wherein: two of said pulley wheels are mounted on said one plate and three of said pulley wheels are mounted on said other plate.

5. The device of claim 1 wherein: said pulley line is made of nylon webbing.

6. The device of claim 1 wherein: said pulley line is a web strip.

7. The device of claim 1 wherein: said device provides a six-to-one mechanical advantage for the user.

* * * * *